US009243429B2

(12) United States Patent
Bendel et al.

(10) Patent No.: US 9,243,429 B2
(45) Date of Patent: Jan. 26, 2016

(54) MOTOR VEHICLE DOOR LOCK

(75) Inventors: Thorsten Bendel, Oberhausen (DE); Claus Töpfer, Sindelfingen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 195 days.

(21) Appl. No.: 13/984,595

(22) PCT Filed: Feb. 8, 2012

(86) PCT No.: PCT/DE2012/000115

§ 371 (c)(1),
(2), (4) Date: Oct. 11, 2013

(87) PCT Pub. No.: WO2012/107024

PCT Pub. Date: Aug. 16, 2012

(65) Prior Publication Data

US 2014/0035295 A1 Feb. 6, 2014

(30) Foreign Application Priority Data

Feb. 9, 2011 (DE) ..... 10 2011 010 816

(51) Int. Cl.

| | |
|---|---|
| ***E05C 3/06*** | (2006.01) |
| ***E05B 77/06*** | (2014.01) |
| ***E05B 85/26*** | (2014.01) |
| *E05C 3/00* | (2006.01) |

(52) U.S. Cl.

CPC ..... *E05B 77/06* (2013.01); *E05B 85/26* (2013.01); *Y10S 292/22* (2013.01); *Y10T 292/0949* (2015.04)

(58) Field of Classification Search

CPC ..... E05B 77/06; Y10S 292/22
USPC ..... 292/216, DIG. 22
See application file for complete search history.

(56) References Cited

U.S. PATENT DOCUMENTS

| | | | | |
|---|---|---|---|---|
| 4,334,704 | A * | 6/1982 | Yamada | 292/216 |
| 5,188,406 | A * | 2/1993 | Sterzenbach et al. | 292/216 |
| 5,865,481 | A * | 2/1999 | Buschmann | 292/216 |
| 6,158,788 | A * | 12/2000 | Ikeda et al. | 292/216 |
| 6,540,271 | B1 * | 4/2003 | Kalsi | 292/216 |

(Continued)

FOREIGN PATENT DOCUMENTS

| | | |
|---|---|---|
| DE | 199 02 561 A1 | 8/2000 |
| DE | 20 2006 012091 U1 | 12/2007 |

(Continued)

OTHER PUBLICATIONS

International Search Report corresponding to PCT Application No. PCT/DE2012/000115 mailed Aug. 22, 2012.

*Primary Examiner* — Carlos Lugo
(74) *Attorney, Agent, or Firm* — Renner, Otto, Boisselle & Sklar, LLP

(57) ABSTRACT

The invention relates to a motor vehicle door lock equipped with a locking mechanism (1, 2, 3), an actuation lever unit that acts on the locking mechanism (1, 2, 3) and includes a release lever (4), and a catch lever (10). The catch lever (10) blocks the locking mechanism (1, 2, 3) at least when acceleration forces of a given magnitude occur, e.g. in case of an accident (crash). According to the invention, the catch lever (10) blocks the locking mechanism (1, 2, 3) in the event of a crash while releasing the locking mechanism (1, 2, 3) only for normal opening operation.

10 Claims, 1 Drawing Sheet

(56) References Cited

U.S. PATENT DOCUMENTS

| | | | | |
|---|---|---|---|---|
| 6,601,883 | B1 * | 8/2003 | Kalsi | 292/216 |
| 8,596,696 | B2 * | 12/2013 | Cumbo et al. | 292/216 |
| 8,827,329 | B2 * | 9/2014 | Scholz et al. | 292/216 |
| 8,919,828 | B2 * | 12/2014 | Barth et al. | 292/216 |
| 8,955,889 | B2 * | 2/2015 | Bendel et al. | 292/200 |
| 2001/0024040 | A1 * | 9/2001 | Spurr | 292/216 |
| 2005/0140146 | A1 * | 6/2005 | Spurr | 292/216 |
| 2005/0140147 | A1 * | 6/2005 | Spurr | 292/216 |
| 2005/0212302 | A1 * | 9/2005 | Fisher | 292/216 |
| 2010/0052336 | A1 * | 3/2010 | Bendel et al. | 292/196 |

FOREIGN PATENT DOCUMENTS

| | | | | | |
|---|---|---|---|---|---|
| GB | 2 409 705 | A | | 7/2005 | |
| JP | 54072816 | A | * | 6/1979 | E05B 65/20 |
| WO | 2009/150225 | A2 | | 12/2009 | |
| WO | WO 2012055387 | | * | 5/2012 | |

* cited by examiner

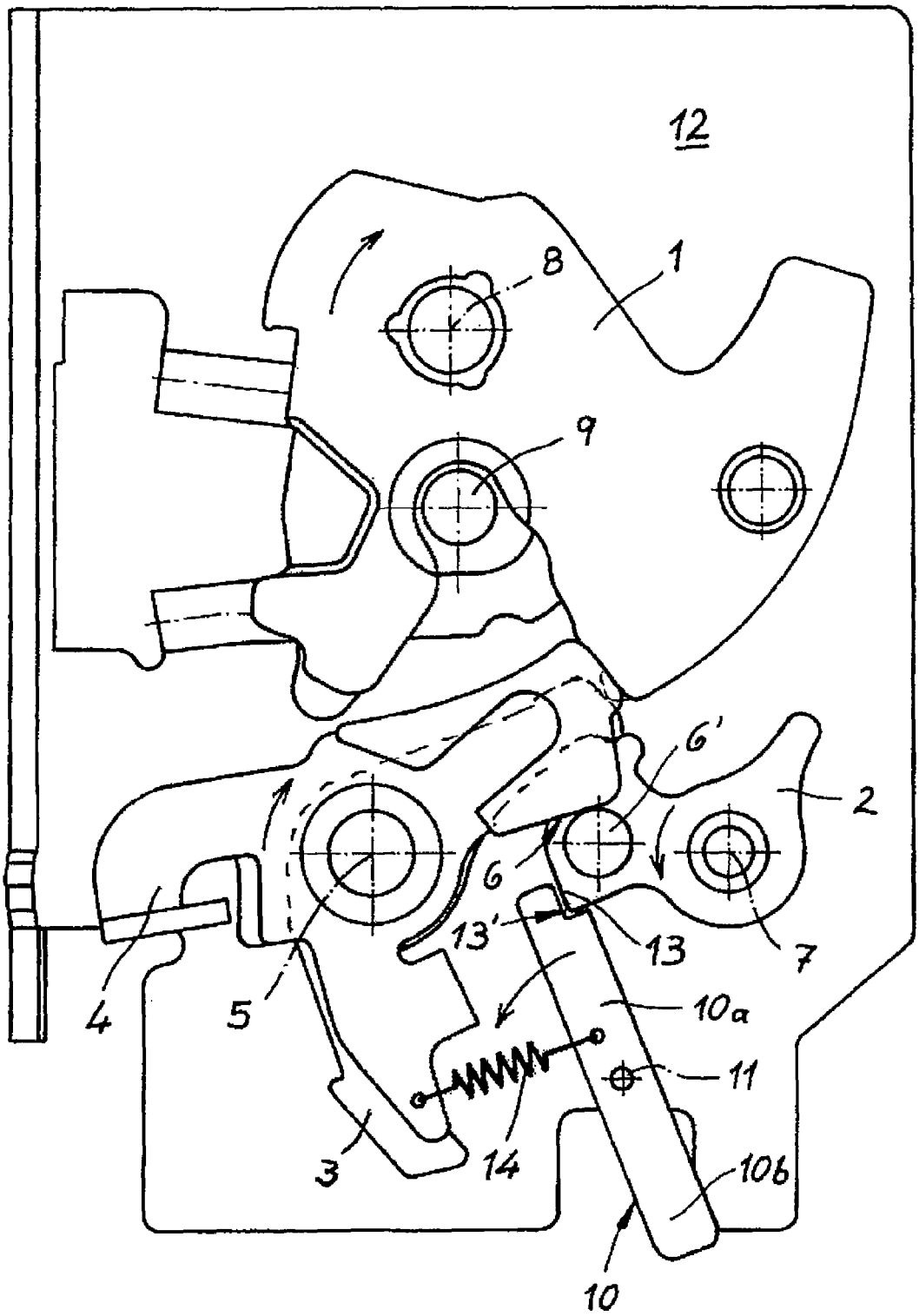
12
8
1
9
6'
2
6
13'
13
7
4
5
10a
11
3
14
10b
10

MOTOR VEHICLE DOOR LOCK

The invention relates to a motor vehicle door lock with a locking mechanism, an actuation lever unit with a release lever acting on the locking mechanism and a catch lever, blocking the locking mechanism at least when acceleration forces of a given magnitude occur, e.g. in case of an accident (crash).

The actuation lever unit generally comprises one or several levers. Normally, the unit contains at least an internal actuating lever, an external actuating lever and a release lever. In addition, the actuation lever unit also often contains a coupling lever. When the actuation lever unit is acted upon, the locking mechanism can be opened in this way. For this purpose, the release lever typically engages with a pawl of the locking mechanism and lifts it off an associated rotary latch. The rotary latch then opens with the assistance of a spring and releases an engaged locking bolt. As a result, an associated motor vehicle door can be opened.

In case of an accident or in the event of a crash, as mentioned above, high acceleration forces occur in most cases, which can be several times greater than the earth's acceleration. The respective motor vehicle door lock is thus exposed to considerable inertia forces which could cause an unintentional opening of the locking mechanism and thus of the entire associated door lock.

These described scenarios represent considerable hazards for vehicle users. A motor vehicle door opened unintentionally can, for instance, no longer provide any safety devices contained therein, such as a side airbag or side impact protection for the protection of the passengers of the vehicle. For this reason, various measures were already implemented in the past that either block the actuation lever unit or the locking mechanism during the occurrence of the described abnormal acceleration forces, e.g. in the event of a crash. In these cases, a so-called inertia lock is used, which is in its rest position under normal operating conditions and is not engaged in the actuation lever unit or the locking mechanism.

A catch lever acting on the actuation lever unit is, for instance, disclosed in DE 197 19 999 A1. The lock or catch lever blocks an opening lever when the described acceleration forces are exerted in case of an accident. For this purpose, the lock or the catch lever and the opening lever are arranged transversely to the swivel direction of the opening lever and are displaceable in relation to each other. In case of a relative displacement caused by increased acceleration forces, the opening lever enters the lock. This aims to prevent unwanted opening in the event of a crash whilst keeping the design simple. A permanent blocking of the opening lever is also generally discussed.

The generic state of the art of DE 19910 513 A1 describes a crash catch on a door lock. This catch contains a pivotable catch lever, which can be pivoted by inertia force around its swivel axis into a blocking position stopping the transmission element. Also, a counter blocking surface is provided, which is fixed in position.

Not all aspects of the prior art are satisfactory. The systems generally work in that the catch lever blocks the actuation lever unit or locking mechanism only during the occurrence of abnormal acceleration forces, e.g. in the event of a crash. In practical application this can result in incorrect functioning, for instance, in case that the movement of the catch lever is blocked or delayed due to corrosion or ageing, etc. Such functional faults can also not be checked, for instance, as part of maintenance, as the catch lever has to be moved, which is not possible in practical application. The invention aims to remedy this situation.

The invention is based on the technical problem of further developing such a motor vehicle door lock in such a way that functional reliability is increased, whilst keeping the design simple.

To solve this technical problem, a generic motor vehicle door lock of the invention is characterized in that the catch lever during non-actuated normal operation and in the event of a crash blocks the locking mechanism and only releases it for normal opening operation.

As part of the invention, the catch lever is thus practically in a permanently active state. For blocking the locking mechanism in the non-actuated state, i.e. in case that the motor vehicle door lock is at rest and the locking mechanism is not deflected, the catch lever is in a blocking position. Typically, the deflected locking mechanism during normal operation causes it to be opened. For this purpose, the pawl is in most cases lifted off the rotary latch.

The last described functional state of the opening of the locking mechanism corresponds to the normal opening operation, provided no excessive acceleration forces are applied to the respective motor vehicle door lock.

The design of the invention is in any case such that the catch lever in the non-actuated state is in the blocking position. The same applies in case of a crash, i.e. the catch lever does not even change its relative position compared to the locking mechanism in case of a crash and blocks a movement of the locking mechanism. This is mainly due to the fact that the catch lever as such is balanced, i.e. that the centre of gravity is at the pivot point of the catch lever.

In detail, the catch lever is typically a swivel lever rotatable around an axis. In this arrangement, the catch lever is in most cases positioned in a lock case together with the locking mechanism, providing the aforementioned components and their mounting with the required rigidity and positional accuracy. The catch lever is generally a two-arm lever consisting of a blocking arm and a compensation arm. The catch lever is also preferably coupled to the actuation lever unit.

At this point an elastic coupling has proven to be particularly advantageous. In most cases this is provided by a spring, connecting the catch lever and the actuation lever unit. Generally, the spring engages with the blocking arm of the catch lever and always in such a way that the catch lever is released during normal operation and thus releases the locking mechanism.

In detail, the catch lever is connected to a release lever of the actuation lever unit. The release lever acts as usual on the blocking pawl of the locking mechanism, i.e. to open it by lifting it. So as soon as the release lever is displaced to remove the blocking pawl from the pawl and to lift the pawl from the rotary latch and thus open the locking mechanism, this swivel movement also ensures that the catch lever is acted upon by the spring. During normal operation this deflection of the release lever causes the catch lever to be "carried along" by the spring between the release lever and the catch lever. The catch lever can consequently not block the locking mechanism in the described opening normal operation.

In normal operation during a non-actuated state the catch lever rests instead in the blocked position loosely against the blocking pawl and blocks said pawl in case of a crash. This is achieved by a spring, returning the catch lever after deflection back to the normal position for the non-actuated state.

The accelerations associated with such a crash generally cause the actuation lever unit to be deflected and also deflect the release lever, as if the pawl is to be lifted from the rotary latch. The mass moment of inertia of the catch lever does, however, ensure that the catch lever does not follow the deflection of the release lever in this crash situation. Instead, the catch lever and the blocking pawl, pressing against the blocking lever as a result of the crash, remain unchanged in its blocking position.

The mass moment of inertia of the catch lever is designed in such a way that even the spring between the release lever and the catch lever and tensioned by the release lever cannot displace said lever.

This shows in any case that the catch lever can block the locking mechanism in case of a crash, when the mass of the lever unit and locking mechanism and the tensioned spring, coupling the release lever and the catch lever cannot overcome the moment of inertia of the catch lever. Consequently, no relative movement takes place between the blocking pawl and the catch lever in case of a crash. In case of a crash, the catch lever thus provides the desired blocking of the locking mechanism.

A further advantageous embodiment provides for the coupling between the catch lever, on one hand and the locking mechanism, on the other hand, to be arranged, for instance, by a cam, a deformation, etc. For this purpose, the catch lever can contain the respective cam or a deformation, interacting with the blocking pawl. Naturally, a reverse arrangement is also possible. In this case it is not the catch lever but the blocking pawl of the locking mechanism that contains the respective cams, the deformation, etc. The shape has to be designed in such a way that the blocking pawl turning in open direction cannot induce an opening torque in the catch lever.

As a result, a motor vehicle door lock is provided, which first of all provides a high level of functional reliability, as the catch lever assigned to the locking mechanism is basically actuated during every deflection in normal operation. For this purpose it is only necessary that the release lever of the actuation lever unit is pivoted into the locking mechanism in the opening sense. During this process, the release lever carries along the catch lever through the interposed spring so that, as a result, the blocking pawl is no longer blocked and can be lifted off the rotary latch by the release lever.

This movement of the catch lever occurring during every opening operation of the locking mechanism, ensures that its functionality practically corresponds to that of the entire motor vehicle door lock. Any functional faults due to corrosion, etc. do not (no longer) occur. All of this is achieved with a simple design limited to a few elements, which is consequently low in cost and quick to produce. These are the main advantages of the invention.

Below, the invention is explained in detail with reference to a drawing showing only one embodiment. The single FIGURE shows a schematic view of the motor vehicle door lock of the invention.

The FIGURE shows a motor vehicle door lock equipped with a locking mechanism 1, 2, 3 consisting of a rotary latch 1, a blocking pawl 2 and a pawl 3. In addition, a release lever 4 is provided, acting on the locking mechanism 1, 2, 3.

To open the locking mechanism 1, 2, 3, the release lever 4 must be pivoted clockwise around its axis 5, as shown by the arrow in the FIGURE. As a result, an edge 6 of the release lever 4 engages with a journal 6' of the blocking pawl 2. This causes the blocking pawl 2 to turn counter-clockwise, as shown by the arrow, around its axis 7. As soon as the blocking pawl 2 has been lifted off the pawl 3, the rotary latch 1 can turn clockwise around its axis 8 by means of the spring and release a latch bolt 9, only indicated in the FIGURE. The latch bolt 9 is connected to a motor vehicle door, also not shown.

The further basic design includes a catch lever 10, rotatably mounted around an axis 11. The axis 8 of the rotary latch 1, the axis 7 of the blocking pawl 2, the axis 5 of the release lever 4 and finally the axis 11 of the catch lever 10 are all defined in a lock case 12. These may be bearing journals essentially arranged in parallel and mainly extend perpendicularly from a base of the lock case 12. This represents naturally only an example and is not limiting the scope of the invention.

The catch lever 10 is designed as a swivel lever 10 rotatable around its axis 11. As already explained, the catch lever 10 and the locking mechanism 1, 2, 3 are arranged in the lock case 12. The catch lever 10 is a two-arm lever consisting of a blocking arm 10*a* and a compensation arm 10*b*.

The blocking arm 10*a* represents the arm of the catch lever 10 facing the blocking pawl 2, whilst the compensation arm 10*b* is facing away from the blocking pawl 2. In the embodiment the blocking arm 10*a* contains a recess or respective deformation 13 with which the edge 13' of the blocking pawl 2 engages. Naturally, also a reverse arrangement is possible. In this case, the blocking pawl 2 contains a deformation 13 and the catch lever 10 features a corresponding edge 13'.

Another option is a cam on the blocking pawl 2 or on the catch lever 10, which is also part of the scope of the invention. The catch lever 10 ensures in any case during normal operation shown in the FIGURE that the blocking pawl 2 is blocked in case of a crash and cannot carry out the counter-clockwise movement around axis 7 during opening, as indicated in the drawing, which is initiated by the release lever 4 during its actuation. In other words, the locking mechanism 1, 2, 3 is blocked, as the catch lever 10 blocks the blocking pawl 2 as described.

It is apparent that the catch lever 10 is coupled with the release lever 4. At this point an elastic coupling in form of a spring 14 is actually provided. This spring 14 connects the catch lever 10 and the release lever 4. Preferably the spring 14 engages a blocking arm 10*a* of the catch lever 10.

Finally, the design of the embodiment is such that the respective axes 5, 7 of the release lever 4 and the blocking pawl 2 are arranged on a connecting line with the catch lever 10 being arranged below the line. In other words, the catch lever 10 is positioned below the connection line of the two axes 5, 7 of, on one hand the release lever 4 and, on the other hand, the blocking pawl 2.

The arrangement functions as follows. In the FIGURE, the locking mechanism 1, 2, 3 is in its closed state. The pawl 3 has engaged in the rotary latch 1. The rotary latch 1 is in its fully closed position. The FIGURE also shows the non-actuated state, i.e. the rest position.

As soon as the release lever 4 is acted upon in this position whilst not subjected to any abnormal acceleration, i.e. during a normal situation, the release lever 4 is acted upon in such a manner that it carries out the clockwise movement around axis 5, as indicated. This pivoting movement of the release lever 4 ensures that the catch lever 10 is also rotated around its axis 11. This is ensured by spring 14, coupling the release lever 4 with the catch lever 10. During this process the catch lever 10 is pivoted around its axis 11 in counter clockwise direction, as shown by an arrow in the FIGURE (opening case).

This means that starting from the normal operation the release lever 4 and the catch lever 10 move synchronously when the release lever 4 is deflected. During this process the catch lever 10 releases the previously blocking pawl 2. As a result, the actuation edge 6 of the release lever 4 can act upon the blocking pawl 2 or its journal 6' during continued movement.

As a result, the actuating edge 6 engaging with the blocking pawl 2 ensures that the blocking pawl 2 carries out the counter-clockwise movement around its axis 7, indicated in the FIGURE. The pawl 3 can subsequently be lifted off the rotary latch 1, which in turn opens with the assistance of the spring and releases the previously engaged latch bolt 9. This corresponds with the normal operation in which the catch lever 10 releases the locking mechanism 1, 2, 3 or the blocking pawl 2.

During closure of the locking mechanism 1, 2, 3 a spring, not shown, on the blocking lever 10 ensures that with the release lever 4 being moved to its original position, the blocking lever is also returned to its non-actuated state, the rest position.

Where, during normal operation corresponding to the functional position shown in the FIGURE, a crash occurs, the release lever 4 can be deflected, depending on the acceleration forces generated and on the direction of the applied force. In other words, the release lever 4 would experience a comparable force in clockwise direction around its axis 5 as during a "normal" actuation. In contrast to this "normal" actuation, inertia forces act on the catch lever 10 and the blocking pawl 2 blocked by the lever in case of a crash. The mass moment of inertia of the catch lever 10 is designed in such a way that the described crash scenario does not cause a relative movement of the catch lever 10 and the blocking pawl 2 is blocked by the catch lever 10.

The design also ensures that the release lever 4 deflected in case of an assumed crash can also not deflect the catch lever 10 with the thus tensioned spring 14 and that the locking mechanism 1, 2, 3 is consequently blocked.

The invention claimed is:

1. Motor vehicle door lock equipped with a locking mechanism having a blocking pawl, an actuation lever unit with a release lever acting on the blocking pawl of the locking mechanism and a catch lever, coupled to the release lever, blocking the blocking pawl of the locking mechanism when subjected to acceleration forces of a given magnitude during an accident (crash), wherein the catch lever is in a blocked position during non-actuated normal operation and in case of a crash, and only releases the blocking pawl when the release lever moves the catch lever and acts on the blocking pawl for normal opening operation of the locking mechanism toward an opening position.

2. Motor vehicle door lock according to claim 1, wherein the catch lever is designed as a swivel lever rotatable around an axis.

3. Motor vehicle door lock according to claim 1, wherein the catch lever and the locking mechanism are arranged in a lock case.

4. Motor vehicle door lock according to claim 1, wherein the catch lever is a double-arm lever with a blocking arm and a compensation arm.

5. Motor vehicle door lock according to claim 1, wherein an elastic coupling is connected between the catch lever and the release lever.

6. Motor vehicle door lock according to claim 1, wherein the catch lever and the release lever are elastically coupled at least by means of a spring.

7. Motor vehicle door lock according to claim 1, wherein the catch lever contains a blocking contour, cam, deformation etc., interacting with the locking mechanism.

8. Motor vehicle door lock according to claim 1, wherein the catch lever interacts with a blocking pawl of the locking mechanism.

9. Motor vehicle door lock according to claim 1, wherein the moment of inertia of the catch lever does not allow any relative movement in case of a crash.

10. Motor vehicle door lock according to claim 1, wherein the inertia forces of the catch lever occurring in case of a crash more or less definitively exceed any coupling forces to the release lever.

* * * * *